US005813815A

United States Patent [19]

Fang et al.

[11] Patent Number: 5,813,815

[45] Date of Patent: Sep. 29, 1998

[54] DUST AND WATER PROOF APPARATUS FOR BULK CARRIER

[75] Inventors: Jin Fang; Andrew Lew, both of Taipei, Taiwan

[73] Assignee: Johnny Yung-Ping Chang, Fremont, Calif.

[21] Appl. No.: 970,705

[22] Filed: Nov. 14, 1997

[51] Int. Cl.[6] ..... B63B 19/14

[52] U.S. Cl. ..... 414/137.4; 114/201 R; 414/137.1; 414/140.7

[58] Field of Search ..... 414/137.1, 137.4, 414/140.7, 140.9, 241; 114/201 R

[56] References Cited

U.S. PATENT DOCUMENTS

| | | | |
|---|---|---|---|
| 2,843,273 | 7/1958 | Sanden | 414/137.4 |
| 3,348,705 | 10/1967 | Yanow | 414/137.4 |
| 5,322,405 | 6/1994 | Swensson et al. | 414/137.4 |
| 5,662,059 | 9/1997 | Franzen et al. | 414/137.4 |

FOREIGN PATENT DOCUMENTS

| | | | |
|---|---|---|---|
| 3225349 | 1/1984 | Germany | 114/201 A |

*Primary Examiner*—David A. Bocci
*Assistant Examiner*—Gregory A. Morse
*Attorney, Agent, or Firm*—Limbach & Limbach L.L.P.

[57] ABSTRACT

A dust and water proof apparatus for a bulk carrier includes a first frame having two opposed sidewalls formed with a respective roller-receiving groove. A second frame is disposed among the sidewalls and two opposed end walls of the first frame, and has two opposed shorter walls provided with rollers which extend into the groove of the corresponding sidewalls, and two opposed longer walls formed with a respective roller-receiving groove. A third frame is disposed among the shorter and longer walls of the second frame, and has two opposed roller-mounted walls provided with rollers which extend into the groove of the corresponding longer walls. A first cover unit includes a first canopy having a first end connected to one end wall and a second end connected to one longer wall, and a second canopy having a first end connected to the other end wall and a second end connected to the other longer wall. A second cover unit includes a first canopy having a first end connected to one shorter wall and a second end connected to one connecting wall of the third frame, and a second canopy having a first end connected to the other shorter wall and a second end connected to the other connecting wall of the third frame.

7 Claims, 8 Drawing Sheets

DUST AND WATER PROOF APPARATUS FOR BULK CARRIER

BACKGROUND OF THE INVENTION

1. Field of The Invention

This invention relates to a dust and water proof apparatus, more particularly to a dust and water proof apparatus for a bulk carrier.

2. Description Of The Related Art

FIG. 1 is a schematic plan view showing how powdery cargoes 10 are unloaded from a bulk carrier 11 at a quay 14. A generally vertical unloading rod member 120 of a conventional shore unloader 12 extends into a cargo hold 110 of the bulk carrier 11 via a cargo hatch 111 of the bulk carrier 11. The unloading rod member 120 is operable, for example, via a suction approach, so as to deliver the powdery cargoes 10 therealong to a generally horizontal transporting rod member 121. The transporting rod member 121 then delivers the powdery cargoes 10 to a silo room 13 at the quay 14 via other conveying equipments. However, since the dimension of the cargo hatch 111 is relatively large, air pollution may result from a gust of wind during the unloading operation. Furthermore, in order to prevent the powdery cargoes 10 from becoming wet, the unloading operation must be temporarily stopped in the event of rainy weather, thereby increasing the costs incurred for the unloading operation.

SUMMARY OF THE INVENTION

Therefore, the object of the present invention is to provide a dust and water proof apparatus for a bulk carrier which can prevent powdery cargoes from becoming wet when unloading during rainy weather, and which can prevent the powdery cargoes from polluting the air during the unloading operation.

According to the present invention, a dust and water proof apparatus is adapted for use with a bulk carrier which has four hatch-defining walls that define a cargo hatch thereamong. The apparatus includes: a rectangular first frame member having two opposed sidewalls and two opposed end walls which interconnect the sidewalls, each of the sidewalls and the end walls being adapted to be located on a respective one of the hatch-defining walls, each of the sidewalls being formed with an elongated roller-receiving groove that extends longitudinally between the opposed end walls; a rectangular second frame member disposed among the sidewalls and the end walls of the first frame members the second frame member having two opposed longer walls which are parallel to the end walls of the first frame member, and two opposed shorter walls which are parallel to the sidewalls of the first frame member, each of the shorter walls having at least two rollers which are mounted rotatably thereon and which extend into the roller-receiving groove of a corresponding one of the sidewalls of the first frame member so that the second frame member is movable relative to the first frame member in a direction parallel to the sidewalls, each of the longer walls being formed with an elongated roller-receiving groove that extends longitudinally between the opposed shorter walls; a rectangular third frame member disposed among the longer an shorter walls of the second frame member, the third frame member having two opposed roller-mounted walls which are parallel to the longer walls of the second frame member and two opposed connecting walls which are parallel to the shorter walls of the second frame member and which interconnect the roller-mounted walls, each of the roller-mounted walls having at least two rollers which are mounted rotatably thereon and which extend rotatably into the roller-receiving groove of a corresponding one of the longer walls of the second frame member so that the third frame member is movable relative to the second frame member in a direction parallel to the longer walls of the second frame member; a first cover unit including a flexible first canopy disposed among the sidewalls of the first frame member, one of the end walls of the first frame member and one of the longer walls of the second frame member, and a flexible second canopy disposed among the sidewalls of the first frame member, the other one of the end walls of the first frame member and the other one of the longer walls of the second frame member, each of the first and second canopies of the first cover unit having a first end portion connected to the corresponding one of the end walls of the first frame member and a second end portion connected to the corresponding one of the longer walls of the second frame member, each of the first and second canopies of the first cover unit having a plurality of equidistant rods which are fixed thereto and which have opposite ends extending out of two sides thereof, each of the rods having a roller which is mounted rotatably to each of the opposite ends thereof and which extends rotatably into the roller-receiving groove of one of the sidewalls of the first frame member; and a second cover unit including a flexible first canopy disposed among the longer walls of the second frame member, one of the shorter walls of the second frame member and one of the connecting walls of the third frame member, and a flexible second canopy disposed among the longer walls of the second frame member, the other one of the shorter walls of the second frame member and the other one of the connecting walls of the third frame member, each of the first and second canopies of the second cover unit having a first end portion connected to the corresponding one of the shorter walls of the second frame member and a second end portion connected to the corresponding one of the connecting walls of the third frame member, each of the first and second canopies of the second cover unit having a plurality of equidistant rods which are fixed thereto and which have opposite ends extending out of two sides thereof, each of the rods having a roller which is mounted rotatably to each of the opposite ends thereof and which extends rotatably into the roller-receiving groove of one of the longer walls of the second frame member.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 7:
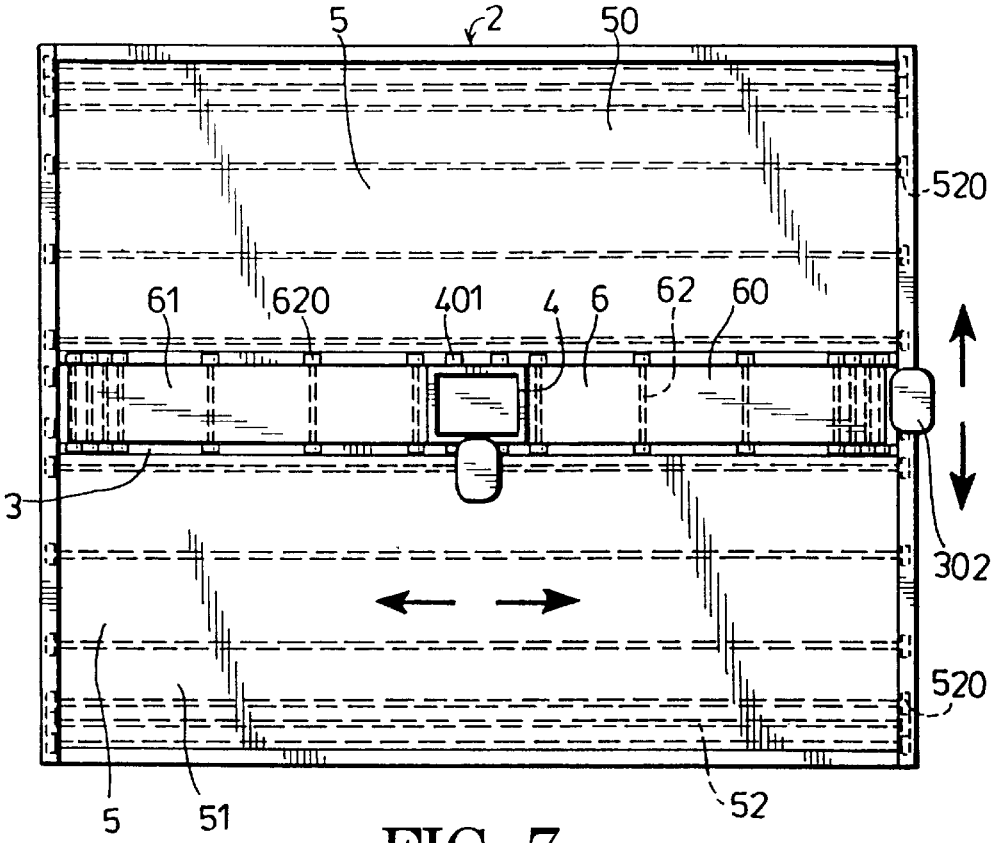
FIG. 7 is a schematic view illustrating the preferred embodiment of a dust and water proof apparatus according to the present invention.

Referring to FIG. 7, the preferred embodiment of a dust and water proof apparatus for a bulk carrier according to the present invention is shown to include a rectangular first frame member 2, a rectangular second frame member 3, a rectangular third frame member 4, a first cover unit 5 and a second cover unit 6.

Figure 1:
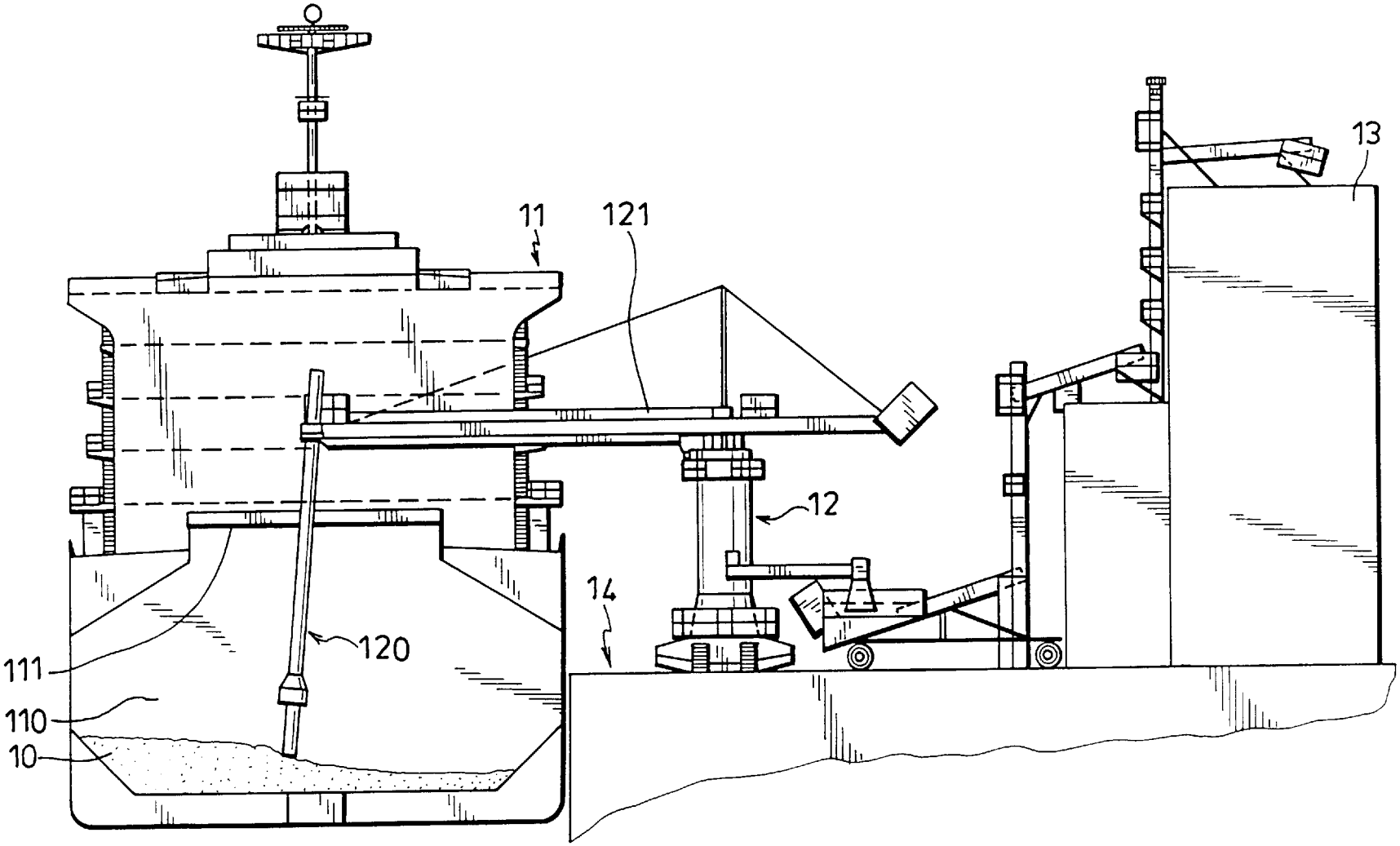
FIG. 1 (PRIOR ART)
FIG. 1 is a schematic view illustrating how powdery cargoes are unloaded from a bulk carrier using a conventional shore unloader.
Figure 2:
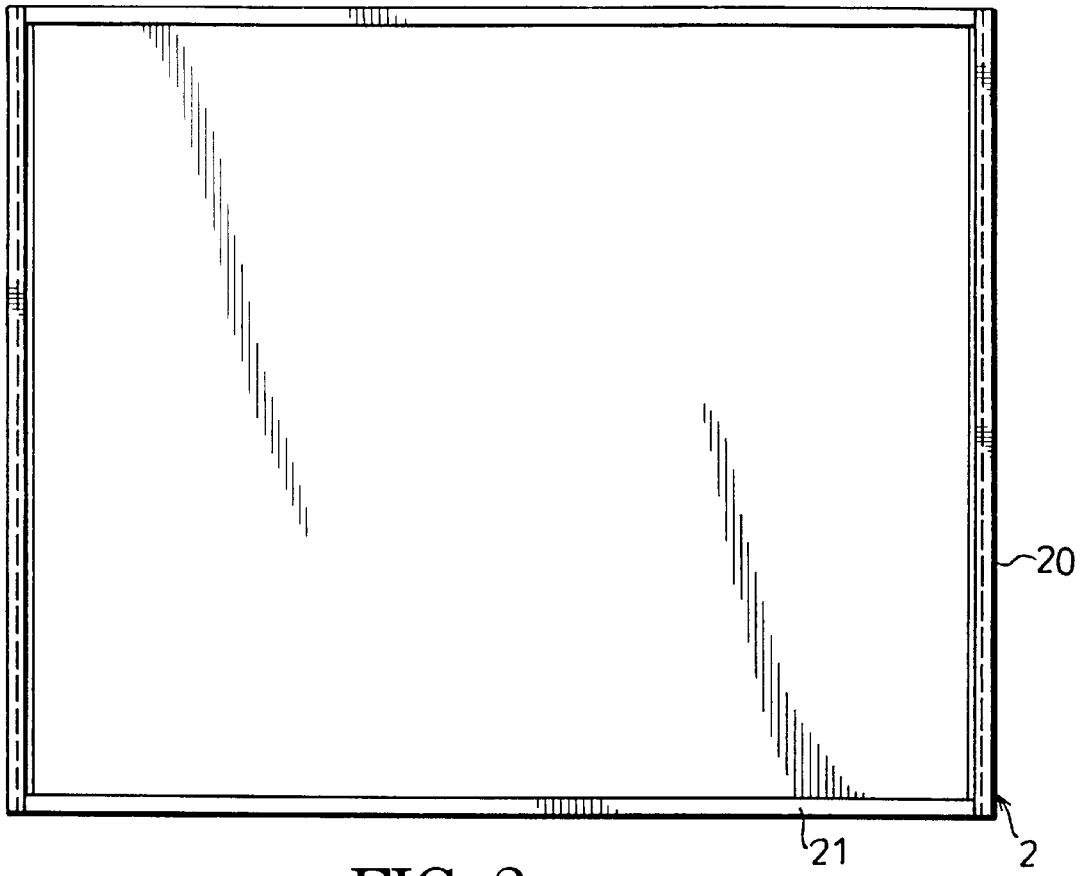
FIG. 2 is a schematic view illustrating a first frame member of a dust and water proof apparatus according to the present invention.
Figure 3:
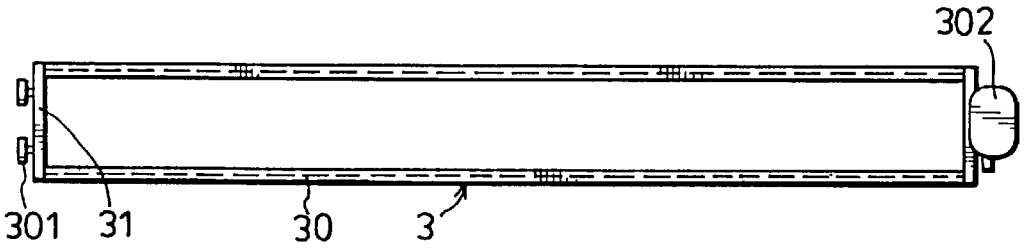
FIG. 3 is a schematic view illustrating a second frame member of a dust and water proof apparatus according to the present invention.
Figure 9:
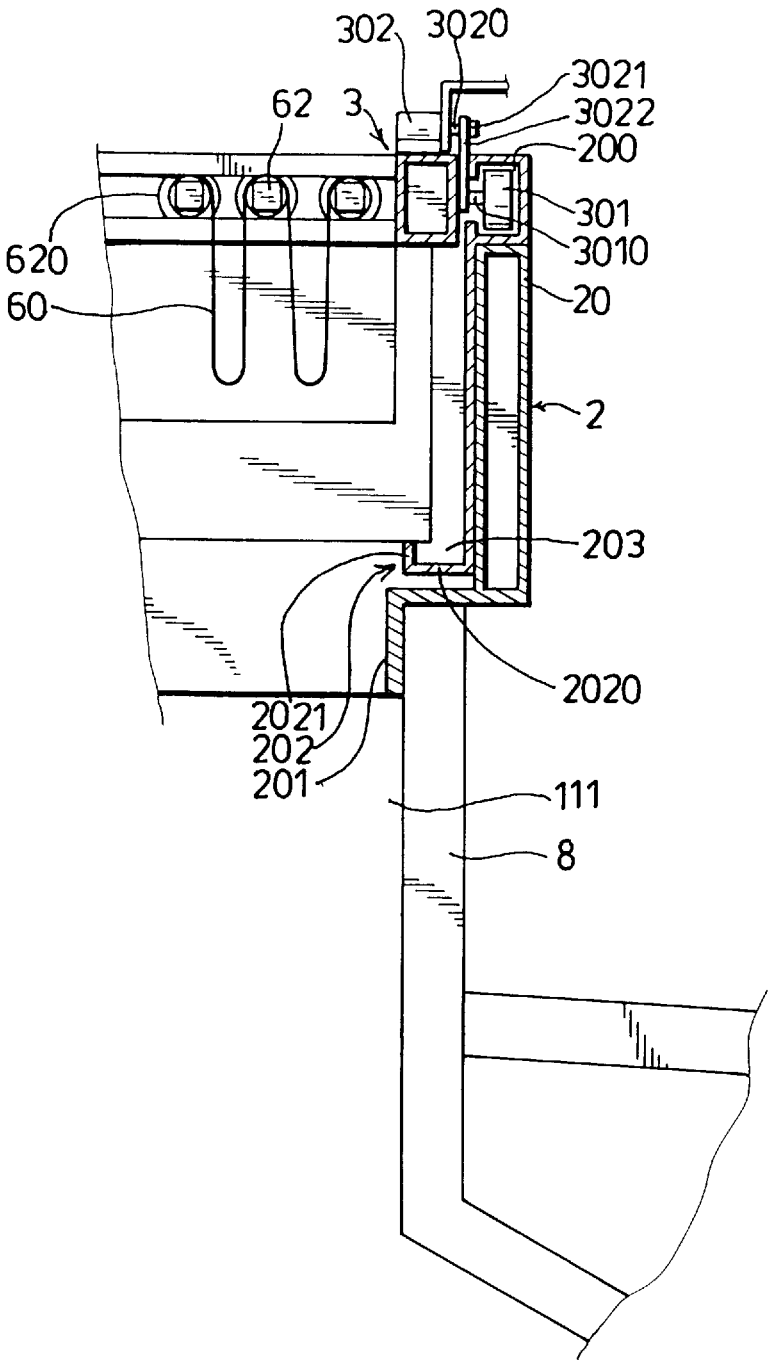
FIG. 9 is an enlarged schematic view illustrating a portion of the preferred embodiment.

As shown in FIG. 2, the rectangular first frame member 2 has two opposed sidewalls 20 and two opposed end walls 21 which interconnect the sidewalls 20. As seen in FIG. 9, each of the sidewalls 20 has an inner surface formed with an elongated roller-receiving groove 200 adjacent to the top of the sidewall 20. Each of the sidewalls 20 and end walls 21 of the first frame member 2 is adapted to be located On one of the hatch-defining walls 8 which define a cargo hatch 110 of a bulk carrier. A downwardly extending flange 201 is formed at the bottom of each of the sidewalls 20 and end walls 21 and abuts against the inner surface of the corresponding hatch-defining wall 8 so as to prevent relative movement between the first frame member 2 and the hatch-defining walls 8. Each of the sidewalls 20 further has an elongated groove-defining plate 202 which is provided on the inner surface thereof above the downwardly extending flange 201 and which extends longitudinally between the opposed end walls 21. The groove-defining plate 202 has a horizontal plate portion 2020 extending from the inner surface of the corresponding sidewall 20, and a vertical plate portion 2021 extending upwardly from the distal end of the horizontal plate portion 2020 so that a water-receiving groove 203 is formed among the inner surface of the sidewall 20, the horizontal plate portion 2020 and vertical plate portion 2021.

Referring to FIGS. 3, 7, 9 and 10, the second frame member 3 is disposed among the sidewalls 20 and end walls 21 of the first frame member 2, and has two opposed longer walls 30 which are parallel to the end walls 21 of the first frame member 2, and two opposed shorter walls 31 which are parallel to the sidewalls 20 of the first frame member 2 and which interconnect the longer walls 30. At least two rollers 301 are mounted rotatably on an outer surface of each of the shorter walls 31 and extend rotatably into the roller-receiving groove 200 of a respective one of the sidewalls 20 of the first frame member 2 so that the second frame member 3 is movable relative to the first frame member 2 in a direction parallel to the sidewalls 20 of the first frame member 2. A bi-directional driving motor 302 is provided on the top of one of the shorter walls 31 of the second frame member 3. The driving motor 302 has a driving shaft 3020 on which a driving pulley 3021 is mounted. As shown in FIG. 9, a driving belt 3022 interconnects the driving pulley 3021 and the axle 3010 of one of the rollers 301 so that activation of the driving shaft 3020 of the driving motor 302 to rotate in either a clockwise direction or a counter-clockwise direction results in corresponding rotation of said one of the rollers 301, thereby moving the second frame member 3 relative to the first frame member 2. Each of the longer walls 30 has an inner surface formed with an elongated roller-receiving groove 300, and a mounting plate 303 extending downwardly from the bottom thereof. An elongated groove-defining plate 304 is provided on an inner surface of the mounting plate 303 of each of the longer walls 30. The groove-defining plate 304 has a horizontal plate portion 3040 extending from the inner surface of the corresponding mounting plate 303, and a vertical plate portion 3041 extending upwardly from the distal end of the horizontal plate portion 3040 so that a water-receiving groove 3042 is formed among the horizontal plate portion 3040, the vertical plate portion 3041, and the inner surface of the mounting plate 303.

Figure 4:
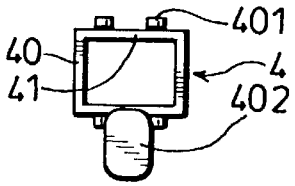
FIG. 4 is a schematic view illustrating a third frame member of a dust and water proof apparatus according to the present invention.
Figure 8:
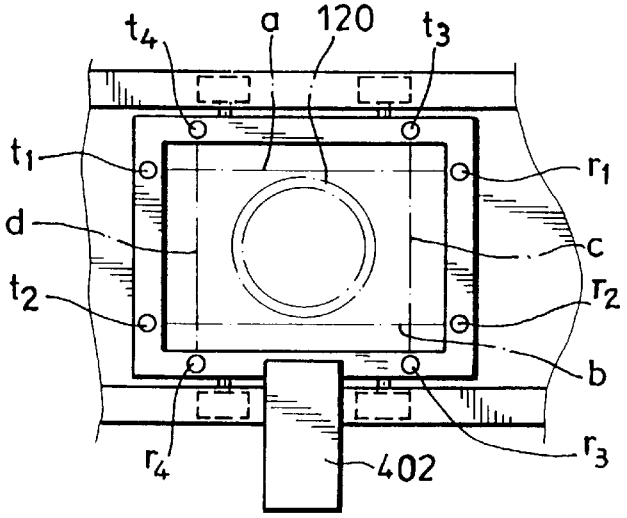
FIG. 8 is an enlarged schematic view showing the arrangement of sensor units of the preferred embodiment.

Referring now to FIGS. 4, 7 and 8, the third frame member 4 is disposed among the longer and shorter walls 30, 31 of the second frame member 3, and has two opposed roller-mounted walls 41 which are parallel to the longer walls 30 of the second frame member 3, and two opposed connecting walls 40 which are parallel to the shorter walls 31 of the second frame member 3 and which interconnect the roller-mounted walls 41. At least two rollers 401 are mounted rotatably on an outer surface of each of the roller-mounted walls 41 and extend into the roller-receiving groove 300 of a respective one of the longer walls 30 of the second frame member 3 so that the third frame member 4 is movable relative to the second frame member 3 in a direction parallel to the longer walls 30. A bi-directional driving motor 402 is provided on the top of one of the roller-mounted walls 41 of the third frame member 4. The driving motor 402 has a driving shaft 4020 on which a driving pulley 4021 is mounted. A driving belt 4022 interconnects the driving pulley 4021 and the axle 4010 of one of the rollers 401 so that activation of the driving shaft 4020 of the driving motor 402 to rotate in either a clockwise direction or a counter-clockwise direction result in corresponding rotation of said one of the rollers 401, thereby moving the third frame member 4 relative to the second frame member 3.

As seen from FIG. 8, in the present embodiment, there are four sensor units provided on the third frame member 4. A first sensor unit is connected electrically to the driving motor 302, and includes a signal transmitter (t1) which is mounted on one of the connecting walls 40 of the third frame member 4 adjacent to one of the roller-mounted walls 41 of the third frame member 4 and which generates continuously a sensing signal, and a signal receiver (r1) which is mounted on the other one of the connecting walls 40 of the third frame member 4 at a position opposite to the signal transmitter (t1) of the first sensor unit and which receives the sensing signal from the signal transmitter (t1) of the first sensor unit. The signal path between the signal transmitter (t1) and the signal receiver (r1) is indicated by a dotted line (a). The driving shaft 3020 of the driving motor 302 is activated to rotate in a clockwise direction when reception of the sensing signal from the signal transmitter (t1) of the first sensor unit by the signal receiver (r1) of the same is interrupted.

A second sensor unit is also connected electrically to the driving motor 302. The second sensor unit includes a signal transmitter (t2) which is mounted on the sate connecting wall 40 as the signal transmitter (t1) adjacent to the other one of the roller-mounted walls 41 of the third frame member 4 and which generates continuously a sensing signal, and a signal receiver (r2) which is mounted on the same connecting wall 40 as the signal receiver (r1) at a position opposite to the signal transmitter (t2) of the second sensor unit and which receives the sensing signal from the signal transmitter (t2) of the second sensor unit. The signal path between the signal transmitter (t2) and the signal receiver (r2) is indicated by a dotted line (b). The driving shaft 3020 of the driving motor 302 is activated to rotate in a counter-clockwise direction when reception of the sensing signal from the signal transmitter (t2) of the second sensor unit by the signal receiver (r2) of the same is interrupted.

A third sensor unit is connected electrically to the driving motor 402. The third sensor unit includes a signal transmitter (t3) which is mounted on one of the roller-mounted walls 41 of the third frame member 4 adjacent to one of the connecting walls 40 of the third frame member 4 and which generates continuously a sensing signal, and a signal receiver (r3) which is mounted on the other one of the roller-mounted walls 41 of the third frame member 4 at a position opposite to the signal transmitter (t3) of the third sensor unit and which receives the sensing signal from the signal transmitter (t3) of the third sensor unit. The signal path between the signal transmitter (t3) and the signal receiver (r3) is indicated by a dotted line (c). The driving shaft 4020 of the driving motor 402 is activated to rotate in a clockwise direction when reception of the sensing signal from the signal transmitter (t3) of the third sensor unit by the signal receiver (r3) of the same is interrupted.

A fourth sensor unit is also connected electrically to the driving motor 402. The second sensor unit includes a signal transmitter (t4) which is mounted on the same roller-mounted wall 41 as the signal transmitter (t3) adjacent to the other one of the connecting walls 40 of the third frame member 4 and which generates continuously a sensing signal, and a signal receiver (r4) which is mounted on the same roller-mounted wall 41 as the signal receiver (r3) at a position opposite to the signal transmitter (t4) of the fourth sensor unit and which receives the sensing signal from the signal transmitter (t4) of the fourth sensor unit. The signal path between the signal transmitter (t4) and the signal receiver (r4) is indicated by a dotted line (d). The driving shaft 4020 of the driving motor 402 is activated to rotate in a counter-clockwise direction when reception of the sensing signal from the signal transmitter (t4) of the fourth sensor unit by the signal receiver (r4) of the same is interrupted.

Figure 5:
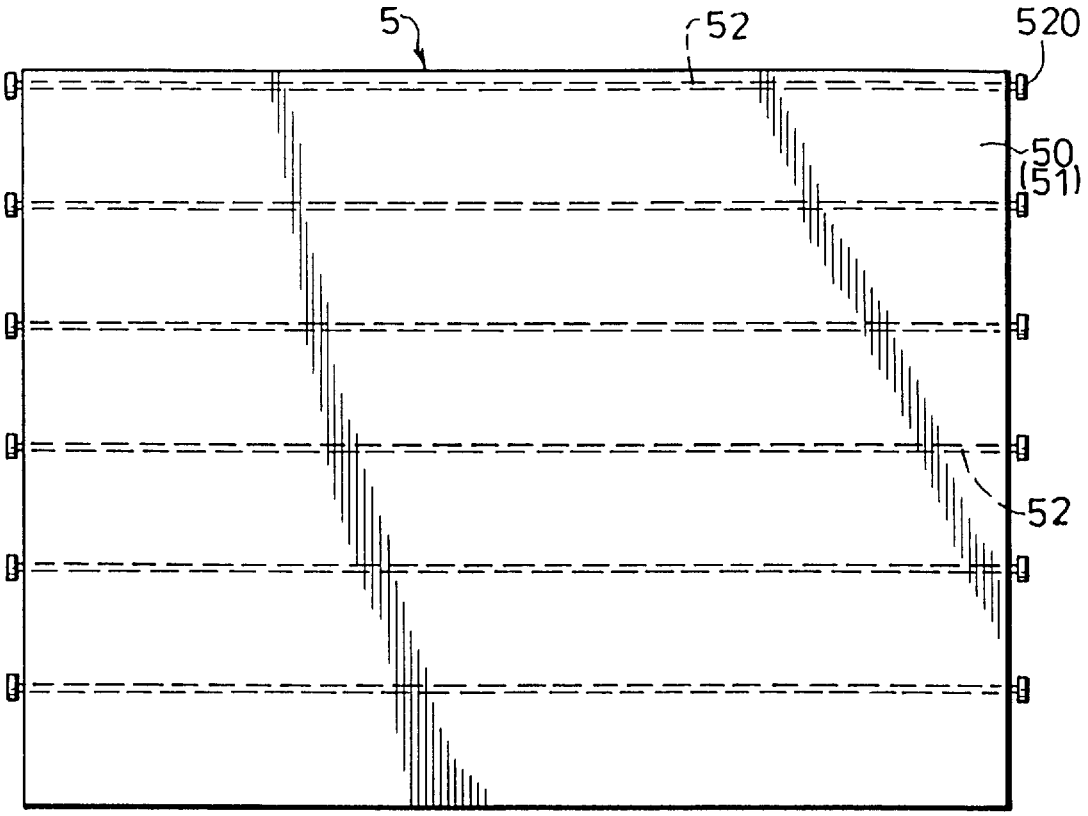
FIG. 5 is a schematic view showing one of two flexible canopies of a first cover unit of a dust and water proof apparatus according to the present invention.
Figure 10:
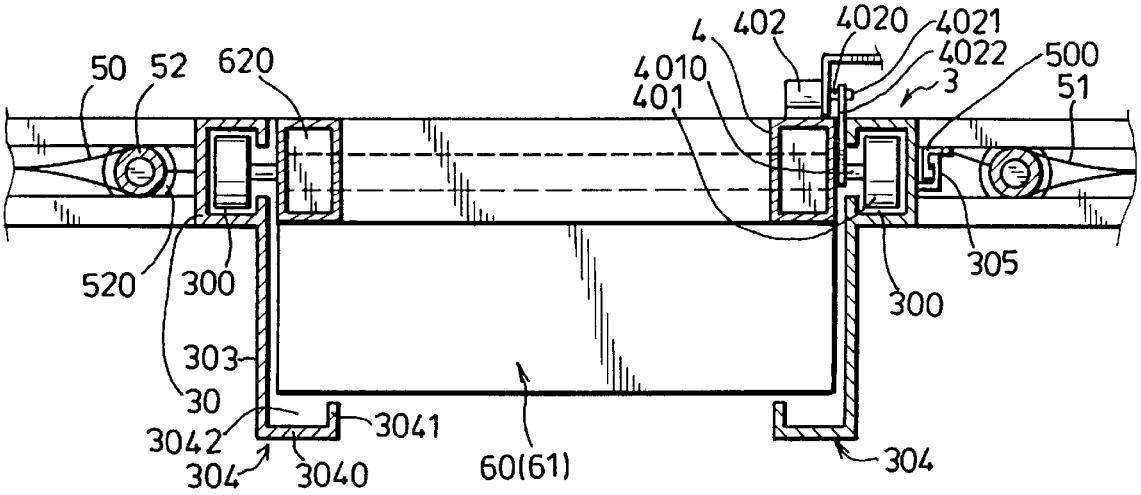
FIG. 10 is an enlarged schematic view illustrating another portion of the preferred embodiment.
Figure 11:
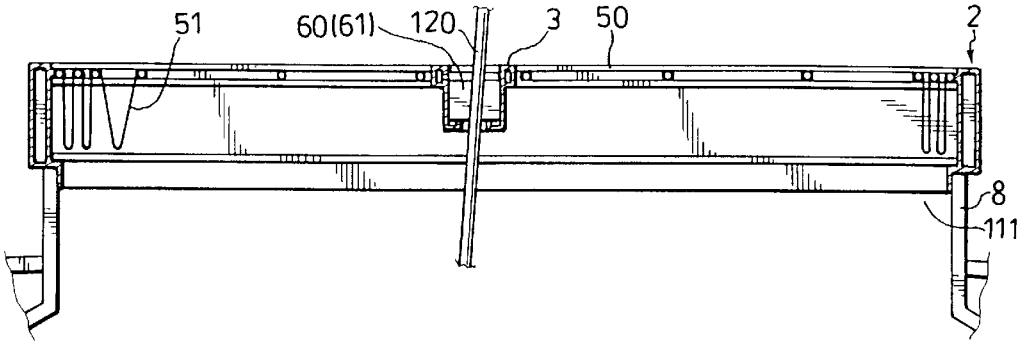
FIG. 11 is a schematic side view of the preferred embodiment during an unloading operation.

Referring to FIGS. 5, 7 and 10, the first cover unit 5 includes a flexible first canopy 50 which is disposed among the sidewalls 20 or the first frame member 2, one of the longer walls 30 of the second frame member 3 and one of the end walls 21 of the first frame member 2, and a flexible second canopy 51 which is disposed among the sidewalls 20 of the first frame member 2, the other one of the longer walls 30 of the second frame member 3 and the other one of the end walls 21 of the first frame member 2. Each of the first and second canopies 50, 51 of the first cover unit 5 has a first end portion connected to the corresponding end wall 21 of the first frame member 2, and a second end portion connected to the corresponding longer wall 30 of the second frame member 3. In the present embodiment, the second end portion of the first canopy 50 of the first cover unit 5 is provided with a hook member 500 which is connected detachably to a complementary hook member 305 formed on the corresponding longer wall 30 of the second frame member 3. Each of the canopies 50, 51 of the first cover unit 5 further has a plurality of equidistant rods 52 which are fixed thereto, such as by stitching, and which have opposite ends extending out of two sides of the canopy 50, 51. Each of the rods 52 has a roller 520 which is mounted rotatably to each of the opposite ends thereof and which extends rotatably into the roller-receiving groove 200 of the first frame member 2.

Figure 6:
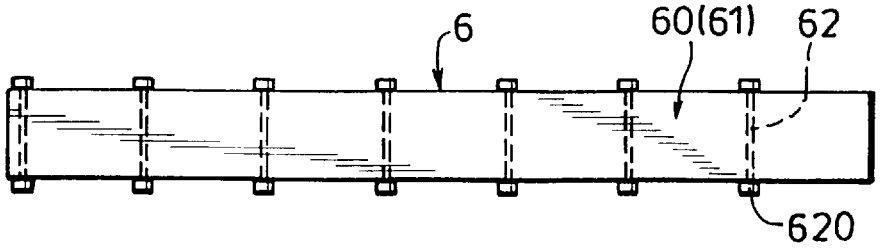
FIG. 6 is a schematic view showing one of two flexible canopies of a second cover unit of a dust and water proof apparatus according to the present invention.
Figure 12:
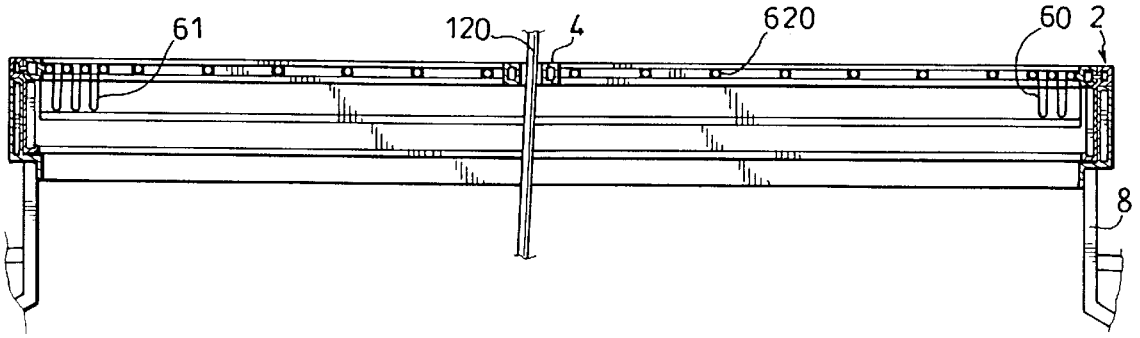
FIG. 12 is another schematic side view of the preferred embodiment during an unloading operation.

Referring to FIGS. 6, 7 and 12, the second cover unit 6 includes a flexible first canopy 60 which is disposed among the longer walls 30 of the second frame member 3, one of the shorter walls 31 of the second frame member 3 and one of the connecting walls 40 of the third frame member 4, and a flexible second canopy 61 which is disposed among the longer walls 30 of the second frame member 3, the other one of the shorter walls 31 of the second frame member 3 and the other one of the connecting walls 40 of the third frame member 4. Each of the first and second canopies 60, 61 of the second cover unit 6 has a first end portion connected to the corresponding shorter wall 31 of the second frame member 3, and a second end portion connected to the corresponding connecting wall 40 of the third frame member 4. Each of the canopies 60, 61 of the second cover unit 6 further has a plurality of equidistant rods 62 which are fixed thereto, for example, by stitching and which have opposite ends extending out of two sides of the canopy 60, 61. Each of the rods 62 has a roller 620 which is mounted rotatably to each of the opposite ends thereof and which extends rotatably into the roller-receiving groove 300 of the second frame member 3.

Referring now to FIGS. 7, 8, 11 and 12, during an unloading operation, a generally vertical unloading rod member 120 of a shore unloader extends into the cargo hold 110 of the bulk carrier via the third frame member 4, and is operated to deliver the powdery cargoes (not shown) therealong. The rod member 120 can be driven to move so as to unload the powdery cargoes in every position of the cargo hold 110. When the rod member 120 intersects one of the singal path (a), (b), (c), (d), that is, the reception of the sensing signal from one of the signal transmitters (t1), (t2), (t3), (t4) by the corresponding signal receiver (r1), (r2), (r3), (r4) is interrupted, the driving shaft 3020, 4020 of the corresponding driving motor 302, 402 is activated to rotate in the clockwise direction or in the counter-clockwise direction, denpending on which signal path (a), (b), (c), (d) is blocked, thereby resulting in movement of a corresponding one of the second and third frame members 3 and 4 in order to prevent collision of the rod member 120 with the walls 40, 41 of the third frame member 4. For example, if the reception of the sensing signal from the signal transmitter (t1) by the signal receiver (r1) is interrupted, the driving shaft 3020 of the driving motor 302 is activated to rotate in a clockwise direction so as to move the second frame member 3 relative to the first frame member 2.

Figure 13:
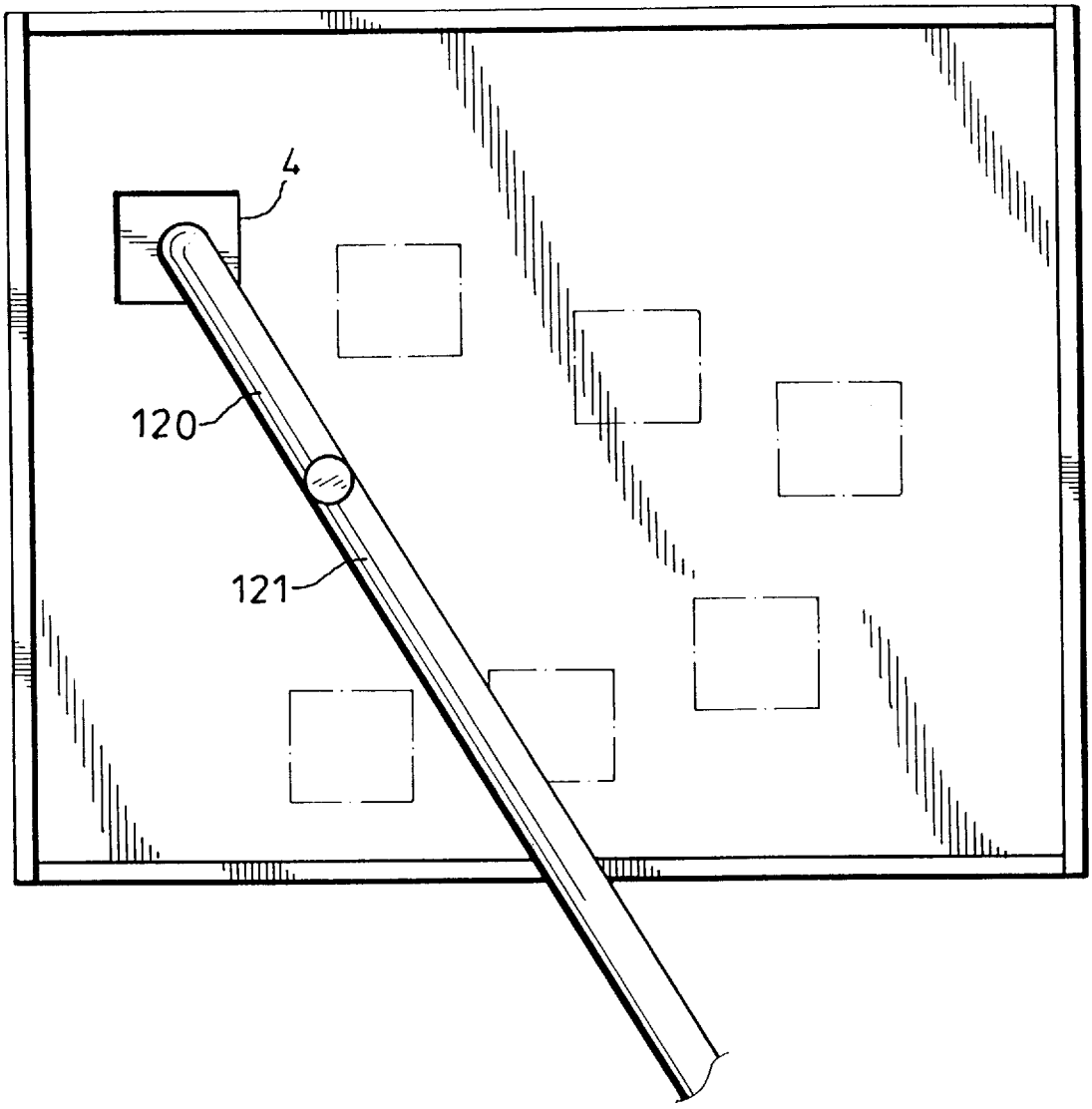
FIG. 13 is a schematic top view illustrating the preferred embodiment during an unloading operation.

As seen from FIG. 13, since the second frame member 3 is movable relative to the first frame member 2, and since the third frame member 4 is movable relative to the second frame member 3, the rod member 120 of the shore unloader is able to extend to any position of the cargo hold 110 without being blocked by the third frame member 4.

It should be noted that, water dropping out of the canopies 50, 51 and 60, 61 of the first and second cover units 5 and 6 via the two sides of the canopies 50, 51 and 60, 61 of the first and second cover units 5 and 6 can be received in the water-receiving groove 203, 3042 and discharged through a discharging hole (not shown).

It should be appreciated that, if the hatch of a bulk carrier is relatively large, more than one dust and water proof apparatus of the present invention may be employed.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A dust and water proof apparatus for a bulk carrier, the bulk carrier having four hatch-defining walls which define a cargo hatch thereamong, said dust and water proof apparatus comprising:

a rectangular first frame member having two opposed sidewalls and two opposed end walls which interconnect said sidewalls, each of said sidewalls and said end walls being adapted to be located on a respective one of the hatch-defining walls, each of said sidewalls being formed with an elongated roller-receiving groove that extends longitudinally between said opposed end walls;

a rectangular second frame member disposed among said sidewalls and said end walls of said first frame member, said second frame member having two opposed longer walls which are parallel to said end walls of said first frame member, and two opposed shorter walls which are parallel to said sidewalls of said first frame member, each of said shorter walls having at least two rollers which are mounted rotatably thereon and which extend into said roller-receiving groove of a corresponding one of said sidewalls of said first frame member so that said second frame member is movable relative to said first frame member in a direction parallel to said sidewalls, each of said longer walls being formed with an elongated roller-receiving groove that extends longitudinally between said opposed shorter walls;

a rectangular third frame member disposed among said longer walls and said shorter walls of said second frame member, said third frame member having two opposed roller-mounted walls which are parallel to said longer walls of said second frame member, and two opposed connecting walls which are parallel to said shorter walls of said second frame member and which interconnect said roller-mounted walls, each of said roller-mounted walls having at least two rollers which are mounted rotatably thereon and which extend rotatably into said roller-receiving groove of a corresponding one of said longer walls of said second frame member so that said third frame member is movable relative to said second frame member in a direction parallel to said longer walls of said second frame member;

a first cover unit including a flexible first canopy disposed among said sidewalls of said first frame member, one of said end walls of said first frame member and one of said longer walls of said second frame member, and a flexible second canopy disposed among said sidewalls of said first frame member, the other one of said end walls of said first frame member and the other one of said longer walls of said second frame member, each of said first and second canopies of said first cover unit having a first end portion connected to corresponding one of said end walls of said first frame member and a second end portion connected to corresponding one of said longer walls of said second frame member, each of said first and second canopies of said first cover unit having a plurality of equidistant rods which are fixed thereto and which have opposite ends extending out of two sides thereof, each of said rods having a roller which is mounted rotatably to each of said opposite ends thereof and which extends rotatably into said roller-receiving groove of one of said sidewalls of said first frame member; and a second cover unit including a flexible first canopy disposed among said longer walls of said second frame member, one of said shorter walls of said second frame member and one of said connecting walls of said third frame member, and a flexible second canopy disposed among said longer walls of said second frame member, the other one of said shorter walls of said second frame member and the other one of said connecting walls of said third frame member, each of said first and second canopies of said second cover unit having a first end portion connected to corresponding one of said shorter walls of said second frame member and a second end portion connected to corresponding one of said connecting walls of said third frame member, each of said first and second canopies of said second cover unit having a plurality of equidistant rods which are fixed thereto and which have opposite ends extending out of two sides thereof, each of said rods having a roller which is mounted rotatably to each of said opposite ends thereof and which extends rotatably into said roller-receiving groove of one of said longer walls of said second frame member.

2. A dust and water proof apparatus as claimed in claim 1, further comprising:

first driving means for driving one of said rollers of said second frame member; and second driving means for driving one of said rollers of said third frame member.

3. A dust and water proof apparatus as claimed in claim 2, wherein said first driving means includes a bi-directional driving motor which is disposed on one of said shorter walls of said second frame member and which has a driving shaft with a driving pulley, and a driving belt which interconnects said driving pulley of said first driving means and said one of said rollers of said second frame member on said one of said shorter walls, and wherein said second driving means includes a bi-directional driving motor which is disposed on one of said roller-mounted walls of said third frame member and which has a driving shaft with a driving pulley, and a driving belt which interconnects said driving pulley of said second driving means and said one of said rollers of said third frame member on said one of said roller-mounted walls.

4. A dust and water proof apparatus as claimed in claim 3, further comprising:

a first sensor unit connected electrically to said first driving motor, said first sensor unit including a signal transmitter which is mounted on one of said connecting walls of said third frame member adjacent to one of said roller-mounted walls of said third frame member and which generates-continuously a sensing signal, and a signal receiver which is mounted on the other one of said connecting walls of said third frame member at a position opposite to said signal transmitter of said first sensor unit and which receives said sensing signal from said signal transmitter of said first sensor unit, said driving shaft of said first driving motor being activated to rotate in a clockwise direction when reception of said sensing signal from said signal transmitter of said first sensor unit by said signal receiver of said first sensor unit is interrupted; and a second sensor unit connected electrically to said first driving motor, said second sensor unit including a signal transmitter which is mounted on one of said connecting walls of said third frame member adjacent to the other one of said roller-mounted walls of said third frame member and which generates continuously a sensing signal, and a signal receiver which is mounted on the other one of said connecting walls of said third frame member at a position opposite to said signal transmitter of said second sensor unit and which receives said sensing signal from said signal transmitter of said second sensor unit, said driving shaft of said first driving motor being activated to rotate in a counter-clockwise direction when reception of said sensing signal from said signal transmitter of said second sensor unit by said signal receiver of said second sensor unit is interrupted.

5. A dust and water proof apparatus as claimed in claim 4, further comprising:

a third sensor unit connected electrically to said second driving motor, said third sensor unit including a signal transmitter which is mounted on one of said roller-mounted walls of said third frame member adjacent to one of said connecting walls of said third frame member and which generates continuously a sensing signal, and a signal receiver which is mounted on the other one of said roller-mounted walls of said third frame member at a position opposite to said signal transmitter of said third sensor unit and which receives said sensing signal from said signal transmitter or said third sensor unit, said driving shaft of said second driving motor being activated to rotate in a clockwise direction when reception of said sensing signal from said signal transmitter of said third sensor unit by said signal receiver of said third sensor unit is interrupted; and a fourth sensor unit connected electrically to said second driving motor, said second sensor unit including a signal transmitter which is mounted on one of said roller-mounted walls of said third frame member adjacent to the other one of said connecting walls of said third frame member and which generates continuously a sensing signal, and a signal receiver which is mounted on the other one of said roller-mounted walls of said third frame member at a position opposite to said signal transmitter of said fourth sensor unit and which receives said sensing signal from said signal transmitter of said fourth sensor unit, said driving shaft of said second driving motor being activated to rotate in a counter-clockwise direction when reception of said sensing signal from said signal transmitter of said fourth sensor unit by said signal receiver of said fourth sensor unit is interrupted.

6. A dust and water proof apparatus as claimed in claim 1, wherein each of said sidewalls of said first frame member has an elongated groove-defining plate which is provided on an inner surface thereof and which extends longitudinally between said opposed end walls, said groove-defining plate having a horizontal plate portion extending from said inner surface of a corresponding said sidewall and a vertical plate portion extending upwardly from said horizontal plate portion so that a water-receiving groove is formed among said inner surface of the corresponding said sidewall, said horizontal plate portion and said vertical plate portion.

7. A dust and water proof apparatus as claimed in claim 1, wherein each of said longer walls of said second frame member has an inner surface formed with a mounting plate which extends downwardly therefrom, and an elongated groove-defining plate which is provided on an inner surface of said mounting plate, said groove-defining plate having a horizontal plate portion extending from said inner surface of said mounting plate and a vertical plate portion extending upwardly from said horizontal plate portion so that a water-receiving groove is formed among said horizontal plate portion, said vertical plate portion, and said inner surface of said mounting plate.

* * * * *